United States Patent [19]

Jooss et al.

[11] 4,002,868

[45] Jan. 11, 1977

[54] MECHANICALLY OPERATED ELECTRIC SWITCH, PARTICULARLY BREAKER CONTACT FOR AUTOMOTIVE IGNITION SYSTEMS

[75] Inventors: Helmut Jooss, Ditzingen; Hartmut Brammer, Stuttgart; Helmut Funke, Munchingen, all of Germany

[73] Assignee: Robert Bosch GmbH, Stuttgart, Germany

[22] Filed: Sept. 2, 1975

[21] Appl. No.: 609,448

[30] Foreign Application Priority Data

Sept. 14, 1974 Germany ..... 2444039

[52] U.S. Cl. ..... 200/30 A; 200/302

[51] Int. Cl.[2] ..... H01H 19/62

[58] Field of Search ..... 200/19 R, 19 A, 30 R, 200/30 A, 30 AA, 144 B, 83 N, 302

[56] References Cited

UNITED STATES PATENTS

| | | | |
|---|---|---|---|
| 1,313,856 | 8/1919 | Cavanagh | 200/30 A |
| 1,464,307 | 8/1923 | Bowlus | 200/83 N |
| 1,466,012 | 8/1923 | Bowlus | 200/83 N |
| 1,836,654 | 12/1931 | Dorn et al. | 200/19 A X |
| 1,935,465 | 11/1933 | Allendorff et al. | 200/30 A |
| 1,997,288 | 4/1935 | Anderson | 200/30 A |
| 3,284,586 | 11/1966 | Gover | 200/19 A |
| 3,339,049 | 8/1967 | Gover | 200/19 A X |
| 3,689,719 | 9/1972 | Phillips et al. | 200/83 N X |

*Primary Examiner*—James R. Scott
*Attorney, Agent, or Firm*—Flynn & Frishauf

[57] ABSTRACT

To improve operating reliability and centric guidance of the switch contacts in sealed breaker contact assemblies, a carrier bolt, extending through a flexible membrane into a chamber, and carrying a movable contact, is operated by a lever which has a lever arm movable in the direction of the cam shaft of the breaker assembly, the lever being V-shaped and pivoted at the apex of the V, and engaging the cam shaft with an arm which is opposite to the arm which operates the contact bolt.

10 Claims, 2 Drawing Figures

MECHANICALLY OPERATED ELECTRIC SWITCH, PARTICULARLY BREAKER CONTACT FOR AUTOMOTIVE IGNITION SYSTEMS

The present invention relates to a mechanically operated switch and more particularly to a switch used as the breaker contact in the ignition systems of automative internal combustion engines, located in a sealed chamber, and opening and closing by deflection of a membrane.

Sealed interrupter or breaker contacts for ignition systems have been proposed; the movable contact is moved out of engagement with the fixed contact upon operation of the switch. The arrangement was unsymmetrical, and led to difficulties regarding support and guidance of the movable contact, or of its operating holding support, or holding bolt, respectively.

It is an object of the present invention to provide a mechanically operated sealed switch, more particularly for use as a breaker contact for internal combustion engines, which has reliable, failure-free operation for a long period of time, and which is simple to construct and inexpensive; additionally , the switch should be capable to be constructed in such a manner that it can be installed in existing distributor and ignition breaker assemblies without, or with only minor modifications.

SUBJECT MATTER OF THE PRESENT INVENTION

Briefly, a structure is provided forming a sealed chamber which is defined at one side by a movable membrane. An operating bolt extends through the membrane, in gas-tight arrangement, and is operated by a lever which, preferably, is V-shaped. The lever is so connected to the operating structure, typically the breaker cam of the distributor, that the direction of opening movement is towards the operating element or structure. Such a construction permits symmetrical contact operation, thus resulting in lower wear and tear, less danger of breakage, and thus improved life and operating reliability.

Figure 1:
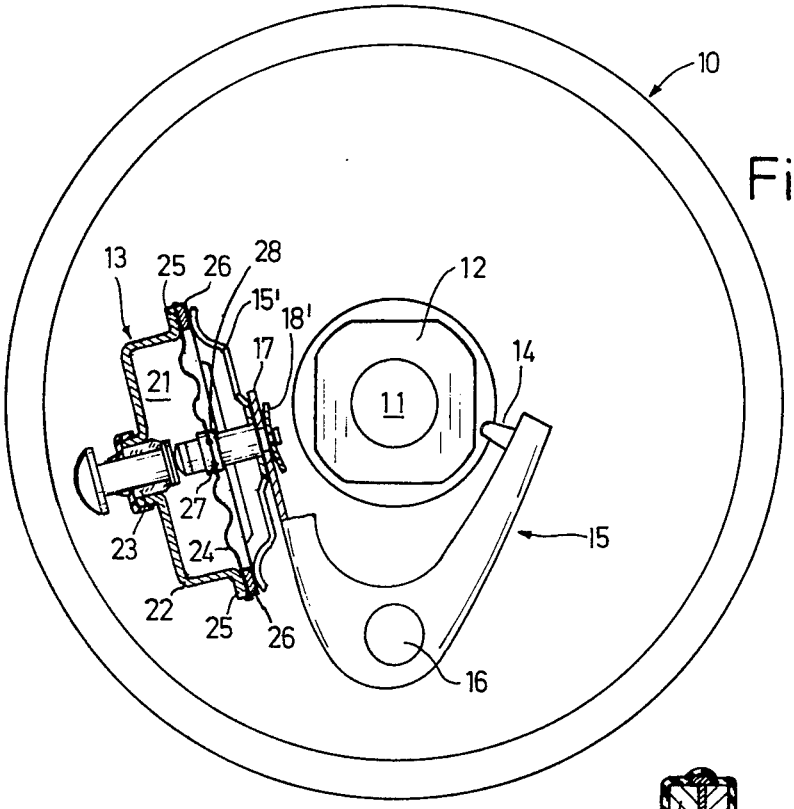
Figure 2:
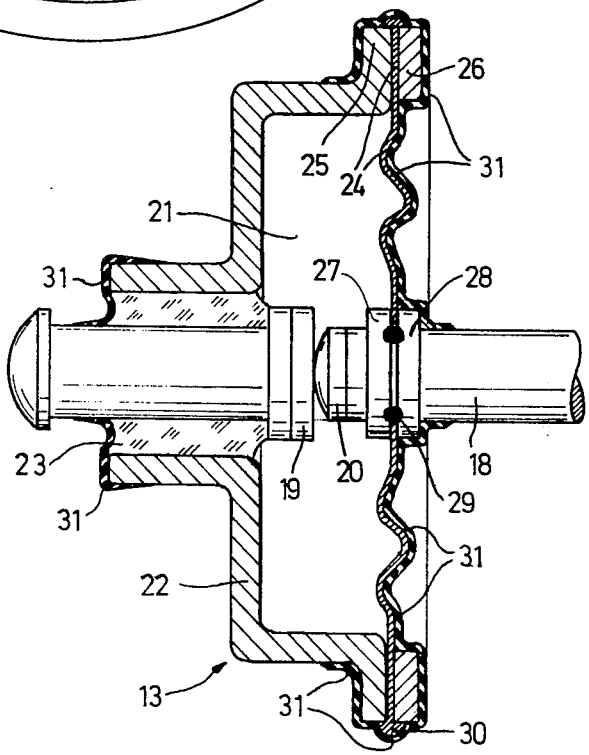

The invention will be described by way of example with reference to the accompanying drawings, wherein:

FIG. 1 is a simplified schematic top view of an ignition breaker assembly, in which non-essential parts have been omitted, partly in section; and FIG. 2 is a greatly enlarged vertical sectional view through the switch of FIG. 1.

A distributor housing 10 has centrally located therein a cam shaft 11 on which an ignition cam 12 is located. Cam 12 is the operating element for an ignition breaker contact 13. The various cam projections of the cam 12 engage a cam follower tip 14 located at the inside of a generally V-shaped lever 15. The lever is pivotally secured to the distributor by a shaft 16. The pivotal attachment is located approximately at the apex of the V of the V-shaped lever 15. The cam shaft 12 is included in the angle formed between the V. The arm of the V-shaped lever 15 which is remote from the arm carrying the cam follower tip 14 is formed with an attachment end 17 which is practically opposite the follower tip 14. The attachment tip 17 is secured to a bolt 18 to operate the breaker contact itself.

The breaker contact assembly includes a housing 22 defining a chamber 21 therein. The housing has fixed walls and is defined at one side by a membrane 24. The membrane 24 is corrugated, so as to be easily deflectable, and the chamber 21 is gas-tight. The chamber 21, defined by the fixed housing portion 22, has a fixed contact 19 set therein, which is sealed through the housing 22 by means of a glass seal 23.

Membrane 24 may have a suitable shape to fit into the contact assembly; it may, for example, have a circular outline. It is connected by plasma welding to the rigid housing portion 22 so as to be gas-tight with respect thereto. A holding ring 26 is located between a flange 25 on the housing portion 22 to protect the membrane; it may extend further than shown in the drawings to provide additional protection.

The movable contact 20 is located centrally on the inner end of operating bolt 18. Operating bolt 18 is formed with a flange-shaped collar 27 which is engaged at the inside of membrane 24 in the center thereof. A holding ring 28 is slid on the operating bolt 18 from the outside and welded to the metallic membrane in the center portion thereof. The center portion of the membrane is not corrugated. Welding is preferably accomplished by means of electron beam welding. A reliable and absolutely gas-tight connection of the bolt 18 through the membrane 24 is thereby obtained, since the membrane is welded by plasma welding at its circumference and collar 27, membrane 24, and ring 28 are welded together by electron beam welding.

The enlarged view of FIG. 2 clearly shows the electron beam weld 29 in the region of the passage of the bolt 18 through membrane 24, as well as the plasma weld 30 along the outer edge of membrane 24.

Lever 15 is connected to the bolt 18 without play by means of a leaf spring 15' which engages the outer end of bolt 18. Bolt 18 is supported on the one hand on the leaf spring 15' and on the other on a slightly dished or bowed disk 18', riveted to the outer end of the bolt 18. The leaf spring 15' compensates underpressure in the gas-tight chamber 21 so that contacts 19, 20 will be normally closed, and will provide good electrical contact with reliable, constant current-carrying capacity at low contact voltage. The lever 15 may be secured to the bolt 18 in various ways; in a preferred form, lever 15 is formed with a lateral opening which surrounds the operating bolt 18. The lever 15, in general, may have U-shaped cross section.

Lever 15 engages the end of the bolt 18 in lifting direction, that is, towards the right in FIG. 1, by engaging the bowed disk 18'. By means of the bowed, or dish-shaped form of disk 18', lever 15 engages bolt 18 always in a central direction, and lateral deflections of the bolt during operation thereof are avoided, thus decreasing deformation of the membrane, and wear and tear on the contacts. For damping, and to further decrease wear and tear, a plastic disk (not shown) may be inserted between the end 17 of the lever 15 and the dished disk 18'.

In accordance with a feature of the invention, the wall surface of the gas-tight chamber 21 is coated at least in part with a flexible cover 31. This cover, on the one hand, covers membrane 24, and on the other those regions where the bolt passes through the membrane 24, the region of the weld seam 30 along the membrane 24, as well as the outer edge of the glass seal 23 for the fixed contact 19. These are the regions in which the sealing may more easily fail, particularly in constant operation, by breakage, or by the formation of fine fissures. No change in variation of internal pressure of the switch can arise which, depending on the particular layout of the switch, materials, and selected sizes may have a disadvantageous effect on the accuracy of switch operation. The gas pressure within chamber 21 must be considered when designing the force with which the external spring 15' presses the contacts together, that is, the contact pressure of contacts 19 and 20 towards each other.

Operation: When the cam shaft 11 with cams 12 rotates, the opening direction of the movable contact 20 is directed towards the cam shaft, that is, towards the operating element for the switch itself, since the lever 15 engages on the one hand the side of the cam shaft remote from that closest to the movable contact 20 and on the other hand engages the outer end of the operating bolt 18. In other words, the lever 15 surrounds the operating element, which is included within the opening bight thereof.

The contact arrangement and the construction of the switch can readily be so selected that it is similar to mass produced ignition breaker contacts, in which a breaker cam 12 is operated as an opening contact. The geometry of the lever 15 can be so fitted that the gap between contacts fits the design gaps specified by the manufacturers of the engines with which the breaker contact is to be used.

Covering the exposed portions of the switch, at least in those regions where movement of the switch elements results, or is transferred thereto, that is, the flexible coating 31, is of particular advantage since the operation of the switch and its reliability are retained even though the seal of the membrane or of the central, fixed contact may be compromised. While it is not necesssary to provide such a coating 31, entirely, or in part (as shown), or at only selected portions, the additional coating ensures reliable operation if the gas pressure in chamber 21 is different from ambient gas pressure. The gas pressure in chamber 21 may be selected to be substantially lower, so that the switch operates as a vacuum switch; or chamber 21 may be filled with an inert protective gas at slight over-pressure. If, under such conditions, the seal to chamber 21 is compromised, the membrane 24 will not be pre-stressed in accordance with design pressures, since the force acting on the movable contact due to change in pressure conditions in chamber 21 has been changed. Contact operation should be essentially independent of pressure conditions in the interior of the switch, since these pressure conditions change with temperature, and thus may influence switching reliability. In actual constructions it is practically impossible to completely eliminate the influence of changes in pressure conditions in the interior of the switch. Direct operation of the contacts is desired, free from any lost motion, or play. It is therefore desirable to at least cover the membrane with a flexible sealing coating. It is also desirable to seal the entrance point of the fixed contact through the wall of the switch defining the chamber. The flexible coating peferably consists of a thermoplastic material of high strength, which can readily be applied to the outside of the switch when heated.

A suitable material for a flexible covering 31 is rubber.

Various changes and modifications may be made within the scope of the inventive concept.

We claim:

1. Sealed electrical switch adapted for cooperation with an operating means (11, 12) located adjacent to, but spaced from the switch comprising a housing structure (13) having rigid walls and including a movable membrane (24) forming another wall of said structure and defining a gas-tight chamber therein;

a fixed electrical contact (19) extending into and sealed through the fixed walls of the housing structure;

a carrier bolt (18) extending through and sealed to the membrane (24) and movable transversely to the major plane of the membrane;

a movable contact (20) carried by the carrier bolt (18) at the portion thereof within the gas-tight chamber;

and motion-transmitting means (15, 16, 17) coupled to the bolt and engageable by the operating means (11, 12) to move the bolt and guide it in contact opening and closing reciprocating movement comprising a double-arm lever of approximately V shape pivoted approximately at the apex of the V, laterally with respect to the operating means (11, 12), and including the operating means in the angle between the arms of the V, one lever arm being shaped for cooperation with said operating means (11, 12), and the other lever arm acting without play on the carrier bolt (18), movement transferred to the carrier bolt being in a direction towards the operating means when movement of the bolt tends to open the contacts.

2. Switch according to claim 1, wherein the lever (15) engages the carrier bolt (18) in a movable joint connection.

3. Switch according to claim 1, further comprising a flexible covering (31) extending over at least a portion of the walls of the housing structure defining the gas-tight chamber (21).

4. Switch according to claim 3, wherein the membrane (24) is coated by the flexible cover (31).

5. Switch according to claim 3, wherein the feed-through of the fixed contact (19) through the housing structure (22) is covered by the flexible cover (31).

6. Switch according to claim 3, wherein the region of the rigid wall of the housing structure (22) in which the membrane (24) is secured is covered by the flexible cover (31).

7. Automotive ignition breaker switch contact assembly comprising the switch of claim 1 wherein the operating means comprises a cam shaft and a cam (11, 12) engageable with the lever, the cam shaft being located in the opening between the arms of the V.

8. Breaker switch contact assembly according to claim 7, wherein the distance between the engagement point of the lever with the cam from the pivot point of the lever, and the connecting point of the lever to the bolt from the pivot point of the lever being approximately the same;

said bolt extending through the membrane at approximately right angles, the operating direction of the bolt, and hence the opening direction of the contacts, upon engagement of the cam with the respective lever arm being approximately perpendicular to the major plane of the membrane.

9. Assembly according to claim 7, wherein the pivot point of the lever (15) is located approximately at an imaginary line bisecting the angle of the V and passing through the axis of the cam shaft (11).

10. Assembly according to claim 7, further comprising spring means (15′) engaging the bolt (18) and the housing structure (13) and biassing the bolt in a direction to maintain the contacts closed, movement of the lever (15) upon engagement by the operating means (11, 12) being counter the bias force exerted by said spring means (15′) and pulling the bolt (18) away from the fixed contact (19).

* * * * *